US011692795B2

(12) United States Patent
Connolly

(10) Patent No.: US 11,692,795 B2
(45) Date of Patent: Jul. 4, 2023

(54) QUICK RELEASE RAIL MOUNTING ASSEMBLY

(71) Applicant: RAYTHEON CANADA LIMITED, Ottawa (CA)

(72) Inventor: John Maxwell Connolly, Midland (CA)

(73) Assignee: RAYTHEON CANADA LIMITED, Ottowa (CA)

( * ) Notice: Subject to any disclaimer, the term of this patent is extended or adjusted under 35 U.S.C. 154(b) by 14 days.

(21) Appl. No.: 17/561,026

(22) Filed: Dec. 23, 2021

(65) Prior Publication Data

US 2022/0357130 A1 Nov. 10, 2022

Related U.S. Application Data

(60) Provisional application No. 63/185,468, filed on May 7, 2021.

(51) Int. Cl.
*F41G 11/00* (2006.01)

(52) U.S. Cl.
CPC ..... *F41G 11/003* (2013.01); *F41G 11/004* (2013.01)

(58) Field of Classification Search
CPC ..... F41G 11/00; F41G 11/003; F41G 11/004
See application file for complete search history.

(56) References Cited

U.S. PATENT DOCUMENTS

| | | | | |
|---|---|---|---|---|
| 6,435,738 | B1 * | 8/2002 | Vogt | F16M 13/00 396/419 |
| 6,931,778 | B1 * | 8/2005 | Nelson | F41G 1/35 42/120 |
| 8,336,246 | B1 | 12/2012 | Barber | |
| 8,438,965 | B2 * | 5/2013 | Collin | F41G 11/003 89/125 |
| 8,468,735 | B1 | 6/2013 | Keng et al. | |
| 8,935,875 | B2 | 1/2015 | Collin et al. | |
| 9,568,281 | B1 * | 2/2017 | Chen | F41A 23/10 |
| 9,581,416 | B1 * | 2/2017 | Yim | F16B 2/185 |
| 10,036,614 | B1 * | 7/2018 | Ruiz | F41G 11/003 |
| 10,557,487 | B2 * | 2/2020 | Larue | F16B 2/185 |
| 10,801,814 | B2 * | 10/2020 | Ma | F41G 11/003 |
| 10,866,066 | B2 * | 12/2020 | Ma | F41G 11/003 |
| 10,895,436 | B2 * | 1/2021 | Ross | F41G 11/004 |

(Continued)

FOREIGN PATENT DOCUMENTS

WO 2017091882 A1 6/2017

*Primary Examiner* — Michelle Clement
(74) *Attorney, Agent, or Firm* — Burns & Levinson, LLP; Joseph M. Maraia

(57) ABSTRACT

A rail mounting assembly for mounting an accessory to a rail of a firearm includes a base portion arranged to support the accessory. The assembly includes a lock nut receiving recess on a first side portion and a moveable clamp on a second side portion where the side portions cooperate to grip the rail. A crossbar extends between the side portions such that the crossbar is movable relative to the moveable clamp. A lock nut is threadably engageable to an end of the crossbar proximate to the first side portion and a lock plate is positioned within the lock nut receiving recess between the lock nut and a spring disk when the lock nut is threadably engaged with the crossbar. The lock nut receiving recess is shaped to prevent rotation of the lock plate while allowing rotation of the lock nut.

20 Claims, 7 Drawing Sheets

(56) References Cited

U.S. PATENT DOCUMENTS

| | | | | |
|---|---|---|---|---|
| 10,955,221 | B2 * | 3/2021 | Duncan, III | F41G 11/003 |
| 2007/0234623 | A1 * | 10/2007 | Carney | F41G 11/004 42/95 |
| 2008/0216380 | A1 | 9/2008 | Teetzel | |
| 2011/0067287 | A1 | 3/2011 | Collin et al. | |
| 2012/0085014 | A1 | 4/2012 | Riley et al. | |
| 2013/0156495 | A1 * | 6/2013 | Li | F16B 2/12 403/322.4 |
| 2014/0137457 | A1 | 5/2014 | Collin et al. | |
| 2015/0362291 | A1 * | 12/2015 | Samson | F41G 11/004 29/428 |
| 2016/0202016 | A1 | 6/2016 | Mather et al. | |
| 2017/0102213 | A1 | 4/2017 | Bartoszewicz | |
| 2018/0259298 | A1 * | 9/2018 | Gao | F16B 2/18 |
| 2018/0340754 | A1 | 11/2018 | Cosentino | |
| 2020/0271423 | A1 | 8/2020 | Liu et al. | |
| 2021/0293512 | A1 * | 9/2021 | Duncan, III | F41G 11/003 |
| 2022/0214142 | A1 * | 7/2022 | Ding | F41G 11/003 |

* cited by examiner

QUICK RELEASE RAIL MOUNTING ASSEMBLY

REFERENCE TO RELATED APPLICATIONS

This application claims priority to and the benefit of U.S. Provisional Patent Application No. 63/185,468, filed on May 7, 2021, entitled "COMPACT LOCKING RAIL MOUNT," the entire content of which are incorporated herein by reference.

TECHNICAL FIELD

This application relates generally to rail mounting assemblies and, more particularly, to quick release rail mounting assemblies.

BACKGROUND

Rail mounting assemblies are used to mount devices such as optical sights or other accessories onto rifles or similar weapons that generate significant shock profiles which poses a challenge to device retention. Existing attempts to retain these devices often include using bolted connections that rely on thread locking adhesive, nylon locking inserts, or similar thread lockers to keep them from backing off. Lever locking rail mount designs commonly used to mount optical sights and other devices are typically more user friendly but can introduce mounting reproducibility errors, elevate product cost, or have retention issues. Such approaches require increasing the clamping force to overcome an over center cam interface to swing the throw lever into the unlocked position and, thereby, act as a primary lock. In some designs, additional mechanical locks are included to prevent loosening of the device. These locks typically include a sliding or rotary key or tabs that act independently from the mounting mechanics to control only the throw lever position, leaving the threaded connection susceptible to loosening off.

Mounting devices such as red dot sights, flashlights, laser beam sights or designators on standard rails such as Picatinny, NATO or other rails used on rifles or similar weapons, often results in mounts with retention issues or cumbersome assemblies. The problem of device retention can result in a progressive loss of performance that may go unnoticed, potentially putting the user and others in danger in the case of a sighting system. In some instances, this failure can result in damage to or loss of the rifle sight or other device. Accordingly, there is a need for more reliable, more resilient, and less cumbersome rail mounting systems.

SUMMARY

The application, in various implementations, addresses deficiencies associated with existing rail mount or mounting systems. The application includes exemplary devices and systems that provide user-friendly quick release capabilities along with reliable and resilient mounting mechanisms that are resistant to substantial and repeated shocks produced by a firearm.

This application describes exemplary systems and assemblies that provide quick and reliable techniques to introduce or remove a device, like an optical sight, from a rifle rail mount. In some implementations, this robust technical solution uses an over center cam on a throw lever to facilitate actuating the rail clamp to lock the device and/or assembly to the rail. Disk springs are used as strong, resilient features in conjunction with compression springs and mechanical locking features to cause an axial movement along a threaded crossbar as the mechanics act to tighten or loosen the rail clamp. One unique aspect of the concept includes integral mechanical locking features that prevent the threaded connection from backing off or otherwise loosening. Using cam features that induce axial movement is desirable as it leverages the disk spring pressure used to clamp the device, while applying it to the mechanical lock features. Various implementations provide a user with an adjustable and tactile positive interface that reduces the likelihood of the thread being over-tightened to the point of damaging the mechanics.

When using a throw lever or similar quick release mechanism, a lock feature may be used to prevent unintended release of the rail clamping mechanics. In such an implementation, a spring assisted lock lever is used to assist the user when engaging and disengaging the lock. The tip of the lock lever engages a notch in the cylindrical surface of the throw lever in a male/female relationship that prevents the throw lever from being rotated into the unlocked position. The intention is to allow the user's index finger knuckle to depress the lock lever while the thumb of the same hand rotates the throw lever past the tip of the lock lever. The lock lever, when released, will ride along the throw lever and locate in the notch provided when the throw lever is again in the clamped position.

In one aspect, a rail mounting assembly provides for mounting an accessory to a rail of a firearm. The accessory may include, without limitations, an optical sight, laser, designator, and/or light. The assembly may include a base arranged to support the accessory. A first side portion may be configured to engage a first side of the rail. The first side portion may include lock nut receiving recess. A second side portion may be configured to engage a second side of the rail. In various implementations, the second side portion is opposite the first side portion and includes a moveable clamp that is movable relative to the first side portion such that the side portions cooperate to grip the rail.

The assembly may include a crossbar extending between the first side portion and the second side portion where the crossbar is movable relative to the moveable clamp. The lock nut may be threadably engageable to an end of the crossbar proximate to the first side portion. The lock nut may extend at least partially into the lock nut receiving recess when threadably engaged to the end of the crossbar proximate to the first side portion. A lock plate may be positioned within the lock nut receiving recess between the lock nut and a spring disk when the lock nut is threadably engaged with the crossbar. The assembly may include a throw lever including a cam interconnected with a second end of the crossbar. The cam may be configured to engage the moveable clamp and be operable to pull the crossbar such that the side portions are moved from a released position to an engaged position. The throw lever may be arranged to rotate the cam between an open and a closed position. The lock nut receiving recess may be shaped to prevent rotation of the lock plate while allowing rotation of the lock nut. The lock nut may include a diameter that is less than the length of a shortest side of the lock nut receiving recess.

The lock plate may include a first surface facing toward the lock nut. The first surface may include a plurality of first locking features and/or structures arranged to engage with a plurality of opposing second locking features on a first surface of the lock nut facing toward the lock plate. The plurality of first locking features and/or structures may include female locking structures and the plurality of second locking features may include male locking structures. The female locking structures may include a set of grooves extending radially from central axis of the lock plate. The male locking structures may include a set of raised surfaces extending radially form a central axis of the lock nut. Each groove of the set of grooves may have a triangular shape. Each raised surface of the set of raised surfaces may have a triangular shape.

The lock plate and lock nut receiving recess may have substantially rectangular shapes. The lock plate may be arranged to be positioned within the lock nut receiving recess. The lock nut may have a substantially cylindrical shape and a threaded central opening arranged to engage with a threaded interface at the end of the crossbar proximate to the first side portion. The lock nut may include a plurality of external sides arranged to form a hexagon. The lock nut may include a second side facing away from the mounting assembly where the second side includes a driver interface arranged to receive a driver to facilitate rotation of the lock nut.

The assembly may include a cam lock operable to lock the moveable cam in a closed position. The cam lock may include a lock lever that is pivotally interconnected with the base and movable between a lock position and an unlock position. The cam may include a locking notch that engages the lock lever when the lock lever is in the lock position to, thereby, lock the cam in the closed position. A portion of the throw lever may rest adjacent to the lock lever when the lock lever is in the unlock position and the moveable cam is in the open position.

The rail mounting assembly may include a spring biased push pin arranged to engage with the lock lever and hold the lock lever in the lock position. The accessory may be detachably connectable to the base. The position of the lock nut along the threaded interface of crossbar may determine a grip force of the rail mounting assembly to the rail. In some configurations, as the lock nut engagement with the threaded interface of crossbar increases, e.g., the lock nut is rotated in a clockwise direction, the grip force of the rail mounting assembly to rail increases.

Any two or more of the features described in this specification, including in this summary section, may be combined to form implementations not specifically described in this specification. While aspects of the disclosure may relate to military applications, these aspects can also relate to non-military and commercial applications. For instance, implementations of the rail mounting assembly may be used with hunting and/or sporting rifles or other non-military firearms. Implementations of the rail mounting assembly described herein may be used to mount various types of accessories to various types of structures and/or items. For example, a rail may in implemented on a vehicle such as a car, truck, bicycle, motorcycle, plane, boat, and the like. A rail may be implemented on a helmet, pack, or other wearable items. The type of accessory may include, without limitation, a camera, phone, light, audio sensor, audio emitter, detachably connectable tool, and the like.

The details of one or more implementations are set forth in the accompanying drawings and the following description. Other features and advantages will be apparent from the description and drawings, and from the claims.

DESCRIPTION OF THE DRAWINGS

Like reference numerals in different figures indicate like elements.

DETAILED DESCRIPTION

The application, in various implementations, addresses deficiencies associated with existing rail mounting devices and systems. The application includes exemplary devices, systems, and assemblies for providing reliable, resilient, and user-friendly rail mounting techniques.

Figure 1:
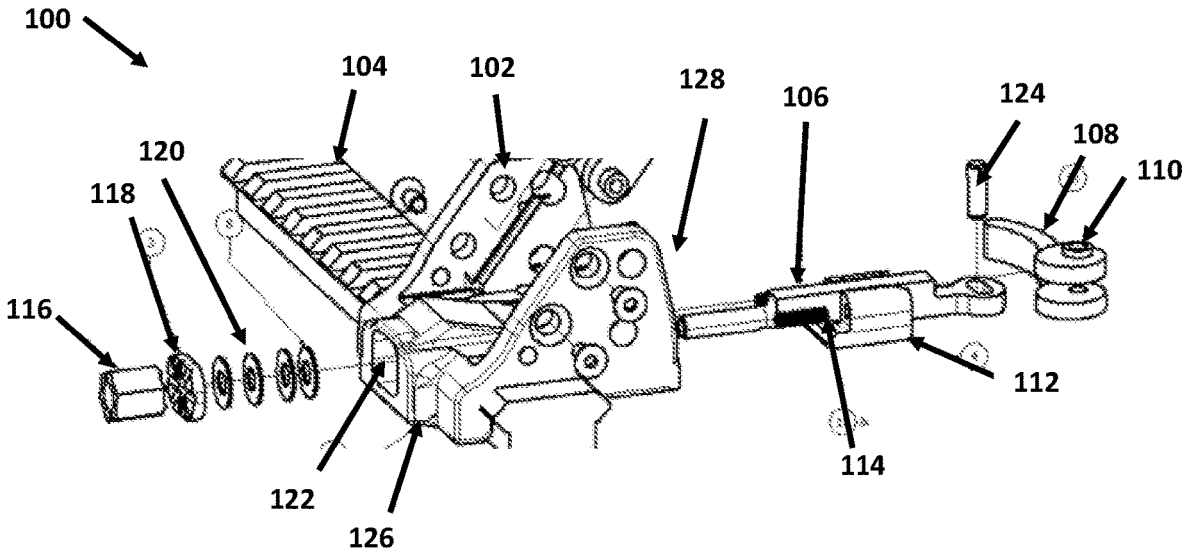
FIG. 1 shows an exploded view of an exemplary rail mounting assembly including a lock nut and lock plate.

FIG. 1 shows an exploded view of an exemplary rail mounting assembly 100 including a lock nut 116 and lock plate 118 that is mounted on a rail 104. The rail mounting assembly 100 also includes a base 102 and a lock nut receiving recess 122 arranged to receive the lock nut 116, lock plate 118, and one or more spring disks 120. The assembly 100 further includes a crossbar 106 that extends between a first side portion 126 and second side portion 128. A throw lever 108 includes a cam 110 and is connected to the crossbar via a pin 124. A moveable clamp 112 is arranged to slideably move along a portion of the crossbar 106 and is positioned adjacent to the second side portion 128 and cam 110. At least one compression spring 114 is positioned adjacent to the crossbar 106 and arranged to apply a spring forces against the one or more spring disks 120 and/or the moveable clamp 112.

In some implementations, the rail mounting assembly 110 provides a quick and reliable mechanism to introduce or remove a device, such as an optical sight, from a rifle rail mount such as assembly 100. This robust solution uses an over center cam 110 on a throw lever 108 to facilitate actuating the rail clamp 112 to lock the device and/or assembly 100 to the rail 104. Disk springs 120 are used as strong, resilient features in conjunction with compression springs 114 and mechanical locking features to cause an axial movement along the threaded crossbar 106, as the mechanics act to tighten or loosen the rail clamp 112. Unique to the concept are integral mechanical locking features preventing the threaded connection of the lock nut 116 to the crossbar 106 from backing off or otherwise loosening. Using cam 106 features that induce axial movement along crossbar 106 is very desirable as it leverages the disk spring 120 pressure used to clamp the device, applying it to the mechanical lock features. The design provides the user with an adjustable, tactile positive interface reducing the likelihood of the thread being over-tightened to the point of damaging the mechanics of assembly 100.

In one implementation, lock plate 118 includes female features on its outward facing side, i.e., facing toward lock nut 116, that are equally distributed while its rectangular shape acts to prevent rotation. These female locking features match with male locking features on the lock nut 116 in terms of their general size and with their respect to their pattern distribution. In some implementations, the angular separation of these features and/or structures are such that the pitch of the clamp screw and the stroke of the spring pressure are arranged to ensure optimal performance.

At least one set of these features, either male or female, must have a cam angle or similar geometry associated to its interface to allow the lock nut to be rotated by the user. In some implementations, the cam angle is between 20 degrees and 45 degrees from the surface of the lock plate 118 and/or lock nut 116. Cam angles or similar geometry on both sets can improve the design's ease of use and the male/female designation is interchangeable.

Resilient devices such as disk springs and/or compression springs 114 may be installed between the base 102 of the assembly 100 and the lock plate 118. As the throw lever 108 is rotated to clamp the device and/or assembly 100 to the rail 104, the crossbar 106 is drawn in and the spring pressure of compression springs 114 is increased. The locking features mate and cam apart as the lock nut 116 is rotated to adjust the clamping pressure. This camming action causes the crossbar 106 to move axially and cause an increase in the spring load as the lock nut 116 disengages and slightly reducing spring pressure when the lock nut 116 features engage with the female locking features integral to the lock plate 118. The engaged features act to lock the locking plate 118 and lock nut 116 together, leveraging the clamping force to resist unintended rotation. The user may continue to tighten the lock nut 116, either by hand or using the tool features provided, until satisfied with the clamping pressure applied or until the lock nut 116 no longer indexes. The mechanics will be at the maximum spring force when the lock nut 116 can no longer be rotated and the locking features in the lock plate 118 and lock nut 116 are mated. When the lock nut 116 has been tightened and the throw lever 108 is in the locked position to secure the assembly 100 to the rail 104, the threaded interface now sees the same spring pressure on its locking features as the rail mounted interface sees.

Integral features on the inward side of the lock nut 116 and outward face of the lock plate 118 are key to both the reliability, compensation of rail interface size variations and for providing user-adjustable clamping force. Incorporating compression springs 114 into the design improves the ease in which the assembly 100 is installed and removed from the rail 104. The use of disk springs 120 allows for a compact design while providing the necessary clamping force to secure the device to the rail 104 and load the locking interface.

The throw lever 108 may be modified to incorporate a notch 506 to provide a feature relationship with a secondary lock lever 508. In applications where a secondary lock is desired, this externally mounted lock lever 508 will be used to prevent the throw lever 108 from being rotated into an open and/or unlocked position. The implementation provides a visible and convenient mechanical interface that requires the user to intentionally overcome while attempting to rotate the throw lever 108. Such a configuration allows a one-handed release of the lock lever 508 and of the throw lever 108 to free the assembly 100 from the rail. This acts on the throw lever 108 to address incidental and unintended rotations of the throw lever 108 which is separate from the retention issue of a threaded connection.

In some implementations, rail mounting assembly 100 provides for mounting an accessory to a rail 104 of a firearm. The accessory may include, without limitations, a optical sight, laser, and/or light. The assembly 100 may include a base 102 arranged to support the accessory. A first side portion 126 may be configured to engage a first side of the rail 104. The first side portion 126 may include lock nut receiving recess 122. A second side portion 128 may be configured to engage a second side of the rail 104. The second side portion 128 is opposite the first side portion 126 and includes a moveable clamp 112 that is movable relative to the first side portion 126 such that the side portions cooperate to grip the rail 104.

The assembly 100 may include a crossbar 106 extending between the first side portion 126 and the second side portion 128 where the crossbar 106 is movable relative to the moveable clamp 112. Lock nut 116 may be threadably engageable to an end of the crossbar 106 proximate to the first side portion 126. The lock nut 116 may extend at least partially into the lock nut receiving recess 122 when threadably engaged to the end of the crossbar 106 proximate to the first side portion 126. A lock plate 118 may be positioned within the lock nut receiving recess 122 between the lock nut 116 and a spring disk 120 when the lock nut 116 is threadably engaged with the crossbar 106. The assembly 100 may include a throw lever 108 including a cam 110 interconnected with a second end of the crossbar 106. The cam 110 may be configured to engage the moveable clamp 112 and be operable to pull the crossbar 106 such that the side portions 126 and 128 are moved from a released position to an engaged position. The throw lever 108 may be arranged to rotate the cam 110 between an open and a closed position. The lock nut receiving recess 122 may be shaped to prevent rotation of the lock plate 118 while allowing rotation of the lock nut 116.

The lock plate 118 may include a first surface facing toward the lock nut 116. The first surface may include a plurality of first locking features and/or structures arranged to engage with a plurality of opposing second locking features on a first surface of the lock nut 116 facing toward the lock plate 118. The plurality of first locking features and/or structures may include female locking structures and the plurality of second locking features may include male locking structures. The female locking structures may include a set of grooves extending radially from central axis of the lock plate 118. The male locking structures may include a set of raised surfaces extending radially form a central axis of the lock nut 116. Each groove of the set of grooves may have a triangular shape. Each raised surface of the set of raised surfaces may have a triangular shape.

The lock plate 118 and lock nut receiving recess 122 may have substantially rectangular shapes. The lock plate 118 may be arranged to be positioned within the lock nut receiving recess 122. The lock nut 116 may have a substantially cylindrical shape and a threaded central opening arranged to engage with a threaded interface at the end of the crossbar 106 proximate to the first side portion 126. The lock nut 116 may include a plurality of external sides arranged to form a hexagon. The lock nut 116 may include a second side facing away from the mounting assembly 100 where the second side includes a driver interface arranged to receive a driver to facilitate rotation of the lock nut 116.

The assembly 100 may include a cam lock operable to lock the moveable cam 110 in a closed position. The cam lock may include a lock lever 508 that is pivotally interconnected with the base 102 and movable between a lock position and an unlock position. The cam 110 may include a locking notch 506 that engages the lock lever 508 when the lock lever 508 is in the lock position to, thereby, lock the cam 110 in the closed position. A portion of the throw lever 108 may rest adjacent to the lock lever 508 when the lock lever 508 is in the unlock position and the moveable cam 110 is in the open position.

The rail mounting assembly 100 may include a spring biased push pin arranged to engage with the lock lever 508 and hold the lock lever 508 in the lock position. The accessory may be detachably connectable to the base 102. The accessory may include at least one of an optical sight, laser, and light source. The position of lock nut 116 along the threaded interface of crossbar 106 may determine a grip force of the rail mounting assembly 100 to the rail 104. In some configurations, as the lock nut 116 engagement with the threaded interface of crossbar 106 increases, the grip force of the rail mounting assembly 100 to rail 104 increases.

Figure 2:
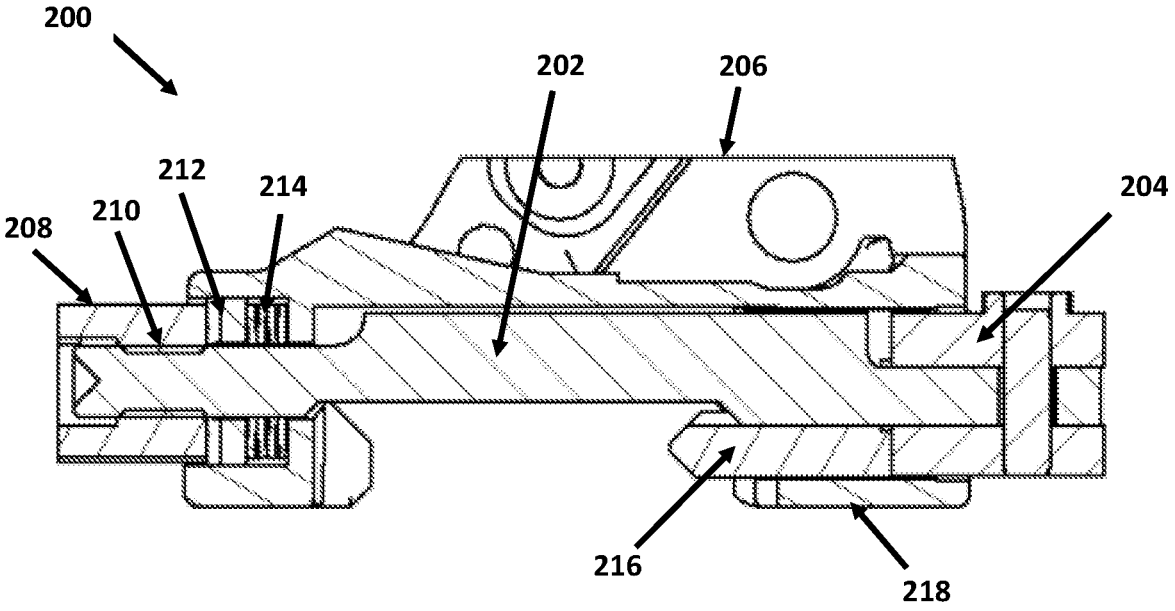
FIG. 2 shows a side cross-sectional view of the rail mounting assembly of FIG. 1.
Figure 3A:
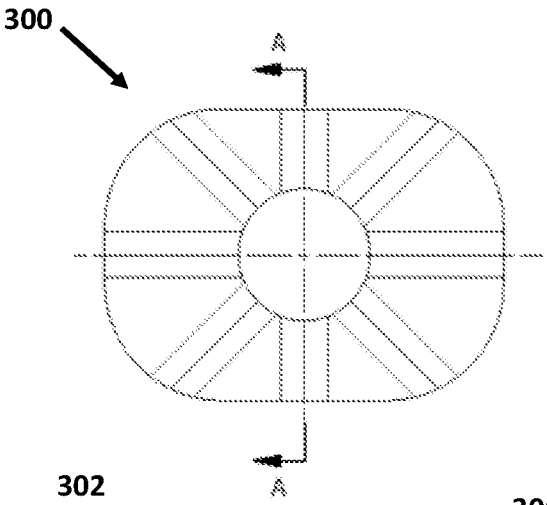
FIGS. 3A-3D show various views of the lock plate of FIG. 1.
Figure 3C:
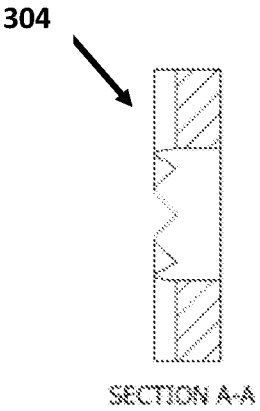
Figure 3B:
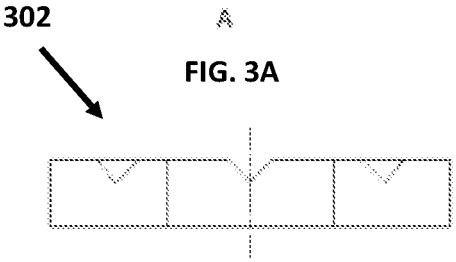
Figure 3D:
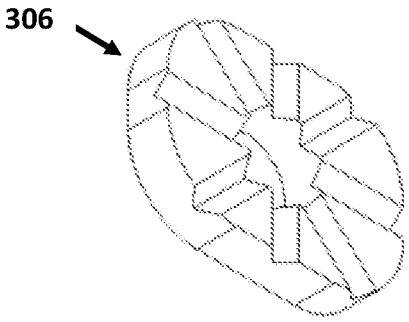
Figure 4A:
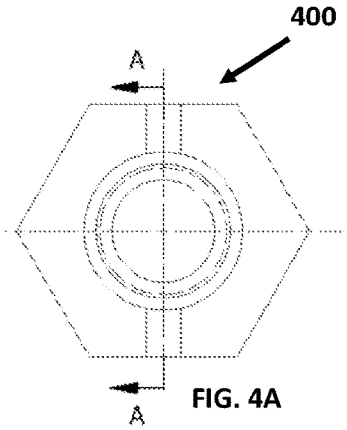
FIGS. 4A-4F show various views of the lock nut of FIG. 1.
Figure 4B:
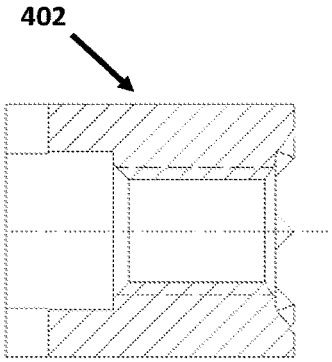
Figure 4C:
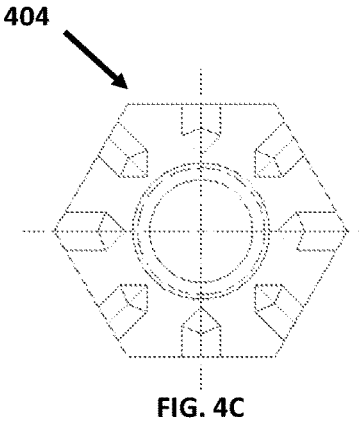
Figure 4D:
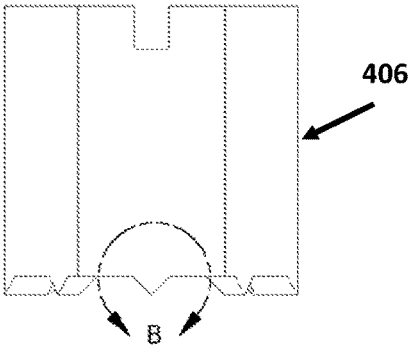
Figure 4E:
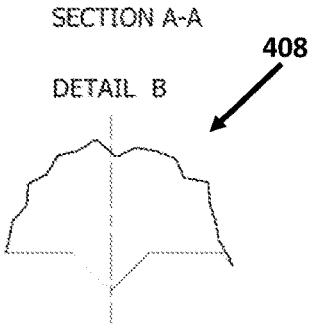
Figure 4F:
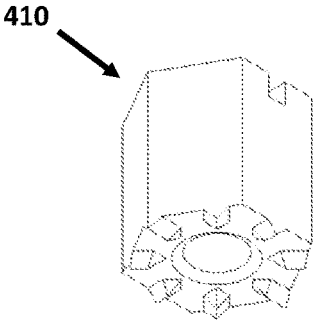

FIG. 2 shows a side cross-sectional view 200 of the rail mounting assembly 100 of FIG. 1 including base 206, crossbar 202, cam 204, lock nut 208, threaded interface 210, lock plate 212, spring disks 214, clamp 216, and heeled surface 218. FIG. 2 illustrates the streamlined configuration of the assembly 100.

FIGS. 3A-3D show various views 300, 302, 304, and 306 of the lock plate 118 of FIG. 1. Views 300 and 306 illustrate how multiple grooves and/or female features extend radially from a central axis in radially outward directions. Views 302 and 304 illustrate the triangular shape of the multiple groves that are arranged to oppose and/or engage with the raised and/or male features of on an opposing surface of lock nut 116.

FIGS. 4A-4F show various views 400, 402, 404, 406, 408, and 410 of the lock nut 116 of FIG. 1. The various views 400-410 illustrate the raised and/or male features on the surface facing toward the lock plate 118. Views 402-410 illustrate how the raised and/or male features extend from a surface of the lock nut. As shown, the raised and/or male features may have a triangular shape that opposed the triangularly shape grooves on the surface of the lock plate. In some implementations, the raised features may reside on the lock plate 118 while the grooved features reside on the lock nut 116.

Figure 5A:
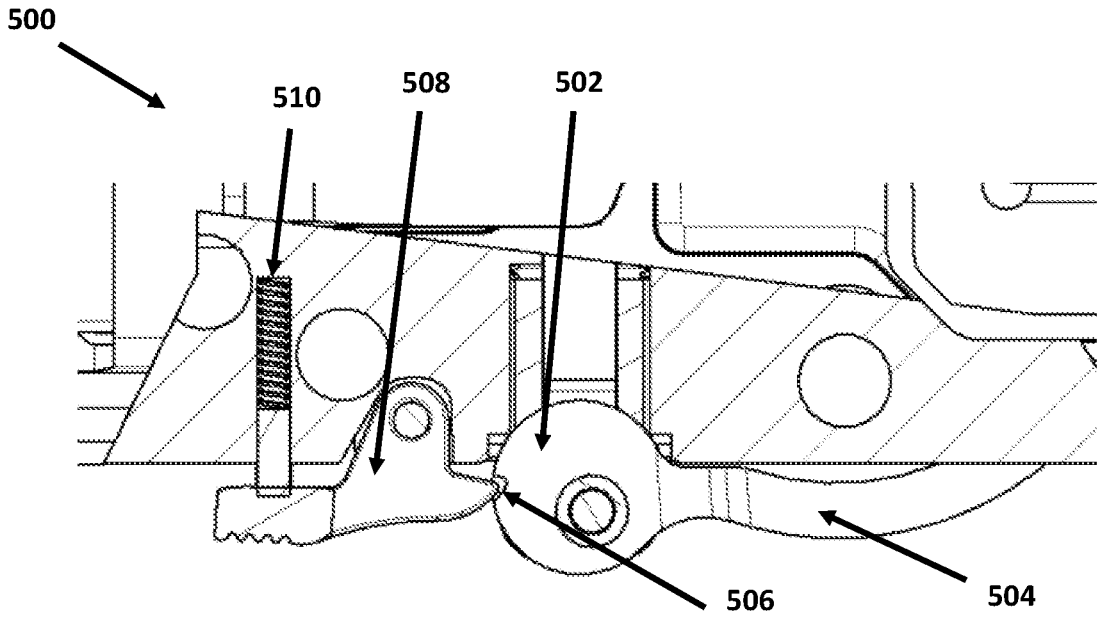
FIG. 5A shows a top-down view of the rail mounting assembly with the throw lever in the lock position.
Figure 5B:
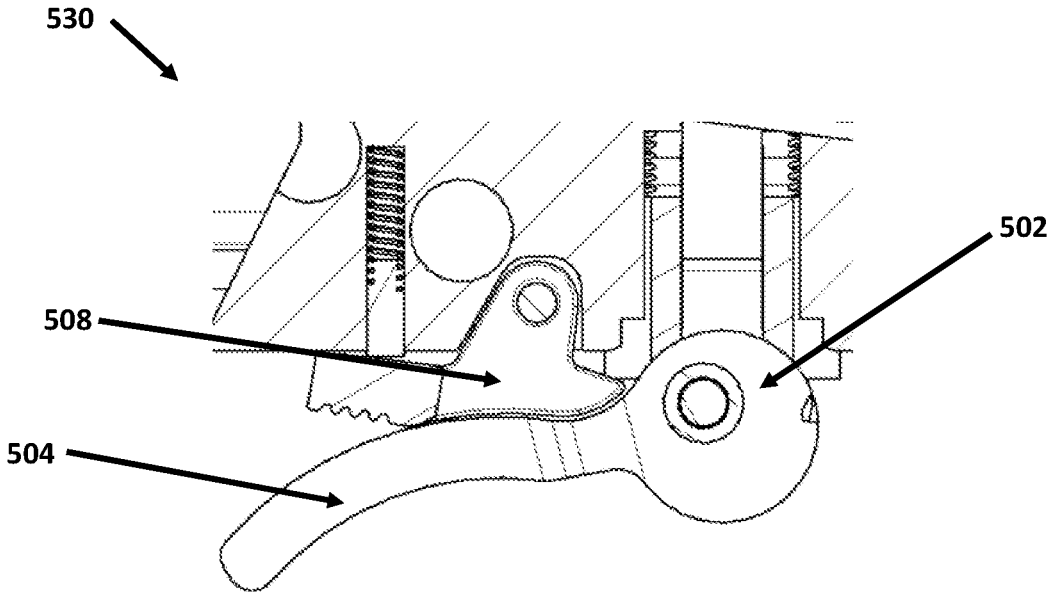
FIG. 5B shows a top-down view of the rail mounting assembly with the throw lever in the unlock position.
Figure 5C:
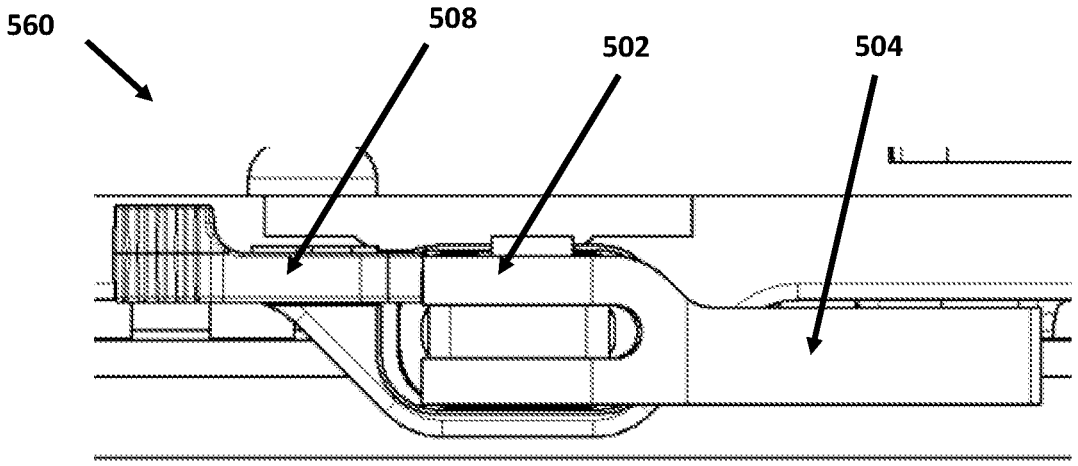
FIG. 5C shows a side view of the rail mounting assembly with the throw lever in the lock position.

FIG. 5A shows a top-down view 500 of the rail mounting assembly 100 with the throw lever 504 in the lock position. When using throw lever 108 and/or 504, a lock lever 508 may be used to prevent unintended release of the rail clamping mechanics provided by cam 110 and/or 502 in the closed position. In one implementation, a spring assisted lock lever 508 is used to assist the user when engaging and disengaging the lock. The tip of the lock lever 508 engages a notch 506 in the cylindrical surface of the throw lever 108 and/or 504 in a male/female relationship that prevents the throw lever 108 and/or 504 from being rotated into the unlocked position. Such a configuration allows the user's index finger knuckle to depress the lock lever 508 while the thumb of the same hand rotates the throw lever 108 and/or 504 past the tip of the locking lever 508. The lock lever 508, when released, will ride along the throw lever 108 and/or 504 and locate in the notch 506 provided when the throw lever 108 and/or 504 is again in the clamped and/or closed position. FIG. 5B shows a top-down view 530 of the rail mounting assembly 100 with the throw lever 108 and/or 504 in the unlock position. In this position, the lock lever 508 rests against a portion of the throw lever 108 and/or 504, which reduces the profile of the assembly 100. FIG. 5C shows a side view 560 of the rail mounting assembly 100 with the throw lever 108 and/or 504 in the lock position. View 560 illustrates the streamlined configuration of assembly 100 in the lock position.

Figure 6A:
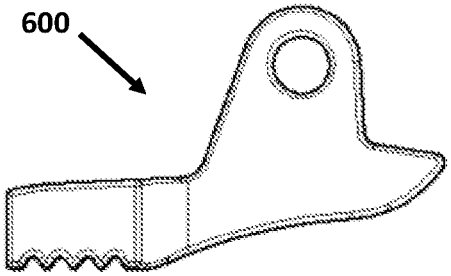
FIGS. 6A-6C show various view of the lock lever.
Figure 6B:
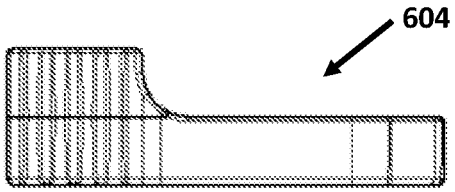
Figure 6C:
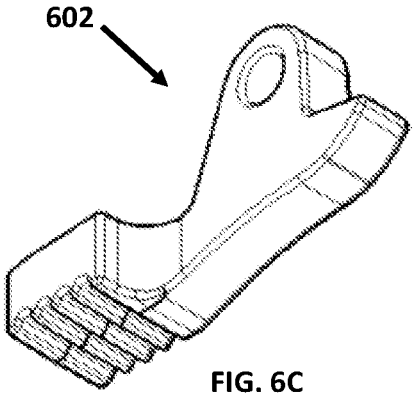

FIGS. 6A-6C show various view 600, 602, and 604 of the lock lever 508. In some implementations, a portion of the lock lever 508 includes grooves to facilitate a more firm engagement with a user's thumb or finger.

Elements or steps of different implementations described may be combined to form other implementations not specifically set forth previously. Elements or steps may be left out of the systems or processes described previously without adversely affecting their operation or the operation of the system in general. Furthermore, various separate elements or steps may be combined into one or more individual elements or steps to perform the functions described in this specification.

Other implementations not specifically described in this specification are also within the scope of the following claims.

What is claimed is:

1. A rail mounting assembly for mounting an accessory to a rail of a firearm comprising:

a base arranged to support the accessory;

a first side portion configured to engage a first side of the rail, the first side portion including a lock nut receiving recess;

a second side portion configured to engage a second side of the rail, the second side portion being opposite the first side portion and including a moveable clamp being movable relative to the first side portion such that the side portions cooperate to grip the rail;

a crossbar extending between the first side portion and the second side portion, the crossbar being movable relative to the moveable clamp;

a lock nut being threadably engageable to an end of the crossbar proximate to the first side portion, the lock nut extending at least partially into the lock nut receiving recess when threadably engaged to the end of the crossbar proximate to the first side portion;

a lock plate positioned within the lock nut receiving recess between the lock nut and a spring disk when the lock nut is threadably engaged with the crossbar;

a throw lever including a cam interconnected with a second end of the crossbar, the cam engaging the moveable clamp and being operable to pull the crossbar such that the side portions are moved from a released position to an engaged position, the throw lever being arranged to rotate the cam between an open and a closed position;

wherein the lock nut receiving recess is shaped to prevent rotation of the lock plate while allowing rotation of the lock nut.

2. The rail mounting assembly of claim 1, wherein the lock plate includes a first surface facing toward the lock nut, the first surface including a plurality of first locking features arranged to engage with a plurality of opposing second locking features on a first surface of the lock nut facing toward the lock plate.

3. The rail mounting assembly of claim 2, wherein the plurality of first locking features include female locking structures and the plurality of second locking features include male locking structures.

4. The rail mounting assembly of claim 3, wherein the female locking structures include a set of grooves extending radially from central axis of the lock plate.

5. The rail mounting assembly of claim 4, wherein the male locking structures include a set of raised surfaces extending radially form a central axis of the lock nut.

6. The rail mounting assembly of claim 5, wherein each groove of the set of grooves has a triangular shape.

7. The rail mounting assembly of claim 6, wherein each raised surface of the set of raised surfaces has a triangular shape.

8. The rail mounting assembly of claim 1, wherein the lock plate and lock nut receiving recess have substantially rectangular shapes, the lock plate being arranged to be positioned within the lock nut receiving recess.

9. The rail mounting assembly of claim 1, wherein the lock nut has a substantially cylindrical shape and a threaded central opening arranged to engage with a threaded interface at the end of the crossbar proximate to the first side portion.

10. The rail mounting assembly of claim 9, wherein the lock nut includes a plurality of sides arranged to form a hexagon.

11. The rail mounting assembly of claim 10, wherein the lock nut includes a second side facing away from the mounting assembly, the second side including a driver interface arranged to receive a driver to facilitate rotation of the lock nut.

12. The rail mounting assembly of claim 1 comprising a cam lock operable to lock the moveable cam in the closed position, the cam lock including a lock lever that is pivotally interconnected with the base portion and movable between a lock position and an unlock position, the cam including a locking notch that engages the lock lever when the lock lever is in the lock position thereby locking the cam in the closed position.

13. The rail mounting assembly of claim 12, wherein a portion of the throw lever rests adjacent to the lock lever when the lock lever is in the unlock position and the moveable cam is in the open position.

14. The rail mounting assembly of claim 12 comprising a spring biased push pin arranged to engage with the lock lever and hold the lock lever in the lock position.

15. The rail mounting assembly of claim 1, wherein the accessory is detachably connectable to the base.

16. The rail mounting assembly of claim 1, wherein the accessory includes at least one of an optical sight, laser, and light source.

17. The rail mounting assembly of claim 1, wherein the lock nut position along the threaded interface of the crossbar determines a grip force of the rail mounting assembly to the rail.

18. The rail mounting assembly of claim 17, wherein as the lock nut engagement with the threaded interface increases, the grip force of the rail mounting assembly increases.

19. A firearm accessory comprising:

a mounting interface arranged to connect the accessory to a rail mounting assembly; and the rail mounting assembly including:

a base arranged to support the accessory;

a first side portion configured to engage a first side of the rail, the first side portion including a lock nut receiving recess;

a second side portion configured to engage a second side of the rail, the second side portion being opposite the first side portion and including a moveable clamp being movable relative to the first side portion such that the side portions cooperate to grip the rail;

a crossbar extending between the first side portion and the second side portion, the crossbar being movable relative to the moveable clamp;

a lock nut being threadably engageable to an end of the crossbar proximate to the first side portion, the lock nut extending at least partially into the lock nut receiving recess when threadably engaged to the end of the crossbar proximate to the first side portion;

a lock plate positioned within the lock nut receiving recess between the lock nut and a spring disk when the lock nut is threadably engaged with the crossbar;

a throw lever including a cam interconnected with a second end of the crossbar, the cam engaging the moveable clamp and being operable to pull the crossbar such that the side portions are moved from a released position to an engaged position, the throw lever being arranged to rotate the cam between an open and a closed position;

wherein the lock nut receiving recess is shaped to prevent rotation of the lock plate while allowing rotation of the lock nut.

20. A firearm comprising:

a rail arranged to receive a rail mounting assembly; and the rail mounting assembly including:

a base arranged to support the accessory;

a first side portion configured to engage a first side of the rail, the first side portion including a lock nut receiving recess;

a second side portion configured to engage a second side of the rail, the second side portion being opposite the first side portion and including a moveable clamp being movable relative to the first side portion such that the side portions cooperate to grip the rail;

a crossbar extending between the first side portion and the second side portion, the crossbar being movable relative to the moveable clamp;

a lock nut being threadably engageable to an end of the crossbar proximate to the first side portion, the lock nut extending at least partially into the lock nut receiving recess when threadably engaged to the end of the crossbar proximate to the first side portion;

a lock plate positioned within the lock nut receiving recess between the lock nut and a spring disk when the lock nut is threadably engaged with the crossbar;

a throw lever including a cam interconnected with a second end of the crossbar, the cam engaging the moveable clamp and being operable to pull the crossbar such that the side portions are moved from a released position to an engaged position, the throw lever being arranged to rotate the cam between an open and a closed position;

wherein the lock nut receiving recess is shaped to prevent rotation of the lock plate while allowing rotation of the lock nut.

* * * * *